US006771925B2

(12) United States Patent
Satoh

(10) Patent No.: US 6,771,925 B2
(45) Date of Patent: Aug. 3, 2004

(54) FIXING DEVICE, WEB DIFFERENTIAL GEAR AND IMAGE FORMATION APPARATUS

(75) Inventor: Masahiko Satoh, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 63 days.

(21) Appl. No.: 10/160,005

(22) Filed: Jun. 4, 2002

(65) Prior Publication Data

US 2003/0002894 A1 Jan. 2, 2003

(30) Foreign Application Priority Data

Jun. 4, 2001 (JP) ..... 2001-168334
Jun. 4, 2001 (JP) ..... 2001-168341
May 7, 2002 (JP) ..... 2002-131243
May 7, 2002 (JP) ..... 2002-131244

(51) Int. Cl.[7] ..... G03G 15/20
(52) U.S. Cl. ..... 399/327
(58) Field of Search ..... 399/324, 325, 399/326, 327; 15/97.1, 103.5

(56) References Cited

U.S. PATENT DOCUMENTS 4,557,588 A * 12/1985 Tomosada
5,168,314 A * 12/1992 Gunji et al. ..... 399/327
5,300,996 A 4/1994 Yokoyama et al.
5,400,123 A 3/1995 Sato et al.
5,832,354 A 11/1998 Kouno et al.
5,848,341 A * 12/1998 Watanabe ..... 399/327
RE36,124 E 3/1999 Yokoyama et al.
5,915,147 A 6/1999 Kouno et al.
5,970,298 A 10/1999 Seki et al.
5,978,640 A * 11/1999 Segawa ..... 399/327
6,223,005 B1 4/2001 Rush et al.
6,226,475 B1 5/2001 Kabumoto et al.
6,259,866 B1 7/2001 Kabumoto et al.
6,305,636 B1 * 10/2001 Satoh et al. ..... 399/327
6,389,249 B2 5/2002 Kabumoto et al.
6,396,410 B1 5/2002 Kabumoto et al.
2001/0043825 A1 * 11/2001 Kim ..... 399/327

FOREIGN PATENT DOCUMENTS

JP 57-76580 5/1982
JP 60-176075 9/1985
JP 02135486 A * 5/1990 ..... G03G/21/00
JP 4-316078 11/1992
JP 5-204274 8/1993
JP 8-152801 6/1996
JP 9-197884 7/1997
JP 10-97153 4/1998
JP 10-149048 6/1998
JP 10-333480 12/1998
JP 11-95600 4/1999
JP 11-125997 5/1999
JP 2000-75717 3/2000
JP 2000-98786 4/2000
JP 2000098792 A * 4/2000 ..... G03G/15/20
JP 2001-42686 2/2001
JP 3174987 * 4/2001
JP 3174987 6/2001
JP 2001-154524 6/2001
JP 2001215839 A * 8/2001 ..... G03G/15/20

* cited by examiner

*Primary Examiner*—Susan Lee
(74) *Attorney, Agent, or Firm*—Oblon, Spivak, McClelland, Maier & Neustadt, P.C.

(57) ABSTRACT

When fixing a toner image formed by using a developing agent containing a fine particle toner to easily enter into the ruggedness of a sheet, a web wound around on a pair of rollers so as to be taken out from one of the rollers to the other roller so that a part of the taken out surface can be contacted with a member which heats and fuses the toner. The web has a configuration for controlling the taking out amount according to the surface state of the sheet for supporting the toner image and the toner use amount so that the offset can certainly be prevented when a small particle size toner is used.

17 Claims, 6 Drawing Sheets

| WEB OPERATION LENGTH RATIO WITH RESPECT TO THE IMAGE FORMATION LENGTH | TRANSFER PAPER (SMOOTH) ← → (COARSE) | | |
|---|---|---|---|
| | A | B | C |
| 0.004% | × | × | × |
| 0.005% | ○ | × | × |
| 0.006% | ○ | × | × |
| 0.007% | ○ | ○ | × |
| 0.008% | ○ | ○ | ○ |

FIXING DEVICE, WEB DIFFERENTIAL GEAR AND IMAGE FORMATION APPARATUS

FIELD OF THE INVENTION

The present invention relates to a fixing device, a web differential gear and an image formation apparatus using the fixing device and the web differential gear. More specifically, it relates to an offset preventing structure in a fixing step.

BACKGROUND OF THE INVENTION

In image formation apparatuses such as copying machines, facsimile, printers and printing machines, there are those having a configuration using an electrophotography method as an image formation method. According to the electrophotography method, a visualizing process is executed for an electrostatic latent image supported on a photosensitive member as the latent image supporting member using a developing agent such as a toner.

As the developing agent used for the visualizing process, a one component type developing agent with a toner itself provided with the charging property and the magnetic property so as to enable conveyance or electrostatic adhesion to the electrostatic latent image and a two component type developing agent including a toner and a carrier are included. Recently, in order to meet the demand for the image quality improvement, a small particle size has been adopted in the toners. By using a small particle size toner, the image quality can be improved by improving the dot reproductivity or the sharpness.

According to an image formation apparatus using the electrophotography method, when the transfer step for the toner image as the visual image supported on the photosensitive member as the latent image supporting member is finished, a fixing step is executed for the sheet with the toner image transferred. In the fixing step, for example, a configuration utilizing a thermal roller fixing method having a fixing roller with a heat source stored and a pressuring roller with an elastic layer on the surface facing with each other in a sheet conveyance path for heating and fusing a toner image so as to be permeated in the sheet can be presented. In addition to the thermal roller fixing method, a fixing method using a belt, a fixing method utilizing a film, as to the heating source, in addition to the heater, a method for heating by induction heating, or the like are discussed.

According to the fixing device, the offset phenomenon has been known for a long time, and various countermeasures have been provided therefore. As one of them, a technique of eliminating the offset toner adhered on the fixing member by cleaning and preventing re-adhesion has been proposed. As an embodiment for cleaning, one comprising a web cleaning device which uses a web has been provided.

The web is made of a non-woven fabric produced as a mixture of fibers of an aramide and a polyethylene terephthalate, is soaked in an oil as needed for eliminating the toner or coating the oil while sliding on the fixing roller surface.

However, recently, for the purpose of improvement of the reproductivity and the sharpness, a fixing device which fixes a toner image formed using a small particle size toner has been developed. When a toner formed using a small particle size toner is fixed, it is confirmed that the amount of the offset toner is extremely large compared with the case of a toner of an ordinary particle size (about 20 μm or more as the volume average particle size).

In order to find the cause thereof, the present inventor has discussed various aspects so as to have the following assumption for the reason. The toner image using a small particle size toner (about 5 μm to 10 μm volume average particle size (average value of the particle size of the toner particles contained in a unit volume)) is fused and permeated while being held and conveyed between the fixing roller and the pressuring roller as in the case of a toner image using a non-small size particle size toner (about 20 μm μor more volume average particle size conventionally used).

In the sheet with the toner image supported, particularly in a paper such as a transfer paper, ruggedness exists on the surface so that when a toner enters in the ruggedness, contact of the fixing roller and the toner is insufficient so that heat cannot be supplied to the toner so as to have the unfixed toner. As a result, there is a risk of fixation of the unfixed toner with insufficient fusion and permeation can be offset on the fixing roller surface.

FIGS. 6A and 6B are diagrams which explain the phenomenon. The toner supported on a sheet S passing through a fixing nipper comprising a fixing roller A and a pressuring roller B shown in FIG. 6A has insufficient contact with the fixing roller A when it is entered in the ruggedness of the sheet, in particular, in the recess part with a wider facing interval with respect to the fixing roller A as shown in FIG. 6B.

Particularly in the case of a small particle size toner, the amount entered in the recess part is large so that the toner in the unfixed state due to the insufficient contact is large as well, and thus the toner amount generating the offset due to the counter transfer to the fixing roller is large as well. An offset preventing layer using a mold releasing agent such as a fluorine resin is formed on the fixing roller A surface for the offset prevention. Depending on the material used for the offset preventing layer such as the fluorine resin, cracking, holes or grooves may be generated as time passes by so that the surface can be rugged. Since a small particle size toner of a less than 5 μm size is used and the size of the cracking, holes or grooves in the offset preventing layer is about 4 to 5 μm, the unfixed toner can easily enter on the sheet.

From the viewpoint of the environment conservation, papers once used for image formation are reused increasingly at the offices. In the case of such papers, ruggedness exists on the surface due to the toner image so that the surface evenness is poorer than an ordinary paper. Therefore, offset can easily be generated in this kind of papers.

As heretofore explained, although a small particle size toner (about 5 μm to 10 μm volume average particle size) provides a higher image quality, it also involves a disadvantage of the offset toner increase. Therefore, at the time of using a small particle size toner, in order to reduce particle size irregularity, a work for further eliminating a small particle size toner is executed in the refining step (one with a less than 5 μm particle size, hereinafter referred to as fine powdery toner). In order to restrain the influence on the image formation apparatus, the fine powdery toner is adjusted to be about 10 number % as a whole (it referred to the number corresponding to 10% of the total particle number).

Recently, cost reduction and resource conservation are highly demanded for the toner so that it is expected that elimination of the work for reuse from the cost reduction viewpoint and recycling instead of abandonment from the resource conservation viewpoint will be demanded in the future. Therefore, a toner without the need of the elimination work (or toner with a simplified elimination) has about a 5 μm to 10 μm volume average particle size, and the fine powdery toner with a less than 5 μm particle size accounts for about as much as 60 to 80% of the whole.

When such a small particle size toner is used, the offset generation ratio is increased drastically compared not only with a toner with an ordinary particle size but also with a small particle size toner with the irregularity adjustment (toner with about a 5 μm to 10 μm volume average particle size, with the irregularity adjustment).

The relationship is shown in the table 1.

TABLE 1

| | Plain paper | Recycled paper |
|---|---|---|
| Ordinary particle size | 80 sheets | 15 sheets |
| Small particle size (with fine powder elimination process application) | 15 | 8 |
| Small particle size (without fine powder elimination process application) | 10 | 5 |

In this experiment, the number of paper passage is counted until the offset toner exceeding the tolerance of the cleaning member pressured against the fixing roller at the time of fixing a solid image on an ordinary A4 plain paper (with a good surface evenness) and a recycled paper (with a poor surface evenness). That is, a condition with a larger paper passage number represents a smaller offset.

Conventionally, in order to prevent the offset in the fixing roller, in addition to the configuration of providing the offset preventing layer, a configuration for eliminating the toner adhered on the fixing roller surface using a cleaning roller or a cleaning pad can be presented. However, according to the configuration, it is difficult to eliminate the toner following the offset amount when the small particle size toner is used. This is because the interval until the elimination amount by the cleaning member becomes shorter when the small particle size toner is used with a large amount of offset generated since the toner scraping amount is limited. Therefore, a problem is involved in that replacement of the member is needed frequently so as to increase the burden in the maintenance work.

The web taking out amount is set variously according to the use condition in the image formation apparatus, however, the taking out amount per unit time is small. That is, since the web installation space and the length of the replacement time are limited, it is not preferable to have a large taking out amount at one time, and thus, the taking amount per unit time is set to be about 0.5 to 2 mm in general.

When the entire web is consumed and taken up, it will be replaced. Therefore, a larger replacement interval is advantageous in terms of the maintenance cost. In the case of a device which has about a 100 sheets/1 minute image output ability, in general, the web operation interval is about 1 time (operation amount 2 mm) per 10 to 20 times (sheets) of the number of image formations, and the maintenance interval is per 300,000 sheets or more. With a longer web total extension distance, the number of winding at the time of being wound on the roller is increased as well.

With an increased number of winding, since the web is a non-woven fabric using a fiber, a gap is generated frequently between the adjacent non-woven fabrics so that the gap is increased between the non-woven fabrics according to the winding operation, and thus the winding loosening can easily be generated thereby.

FIGS. 7A, 7B and 7C are diagrams which show the phenomenon. As shown in FIG. 7A, when the number of winding is increased, the gap is generated frequently between the non-woven fabrics so that even when the taking up side roller shown by the mark A is rotated, only the gap between the non-woven fabrics is squeezed as shown in FIGS. 7B and 7C without movement of the web itself. As a result, the same surface of the web (part shown by the mark P in FIGS. 7A, 7B and C) is contacted on the fixing roller surface for a long time so that not only the offset toner or the foreign substance cannot be wiped off but also there is a risk of re-adhesion of the pollutant once wiped off onto the fixing roller surface due to inability of supporting the pollutant by the web itself.

Conventionally, as a configuration for preventing winding loosening of the web, the configuration provided with a member which pressures the surface of the taken out web has been proposed (for example, the Japanese Patent Application Laid-Open No. 63-50879). Moreover, the Japanese Patent Application Laid-Open No. 11-95600 discloses a configuration of contacting a braking member with a taking out shaft and pulling the braking member which applies the rotation load directly on the taking out side rotation shaft.

In the case of the former technique, not only damage of the web itself, in particular, the surface cannot be avoided but also the impregnated oil can be squeezed out since the web itself is in the squeezed state. Moreover, when the rotation load is increased, the web fiber becomes fluffy so as to fall of the fiber, and furthermore, when the winding diameter on the taking out roller side becomes large (the web extension distance is prolonged), the web roll shape collapses due to the pressuring force, and thus a problem of difficulty in the winding operation is involved.

In the case of the latter technique, since the rotation load is generated directly on the shaft, although the damage of the web itself as in the former case can be avoided, according to the configuration of providing the rotation load by a plate spring for executing winding fastening, since both the plate spring and the taking out shaft are rigid members, the contactor thereof has little engagement by deformation at the time of pressuring, even when the plate spring thickness is increased, the rotation load can be provided to the taking out shaft to about 100 gf·cm at most. That is, according to the rotation load by the plate spring, it is impossible to provide the necessary rotation load. Then, the present inventor has executed an experiment for finding out to what extent the rotation load is needed.

FIG. 8 is a graph which shows the rotation load value in the vertical axis and the slackening generation extent in the horizontal axis, with the results shown therein.

As it is apparent from the results shown in FIG. 8, with a longer web length, the gap between the non-woven fabrics is increased so as to easily generate loosening, and thus the pressuring force of the pressuring member should be increased gradually. According to the experiment, when a rotation load of 140 gf·cm is applied on the web taking out side roller, loosening is generated when the web is taken up by 16 m so that the web cannot be moved so as to generate cleaning failure. On the other hand, when a rotation load of 150 gf·cm is applied, the winding failure is not generated even when it is used to 30 m.

SUMMARY OF THE INVENTION

It is an object of the present invention to provide an image formation apparatus capable of certainly preventing generation of offset, the present invention is to provide a fixing device and an image formation apparatus comprising a configuration capable of certainly preventing generation of offset particularly when a small particle size toner is used. Furthermore, it is an object of the present invention to provide a fixing device and an image formation apparatus comprising a configuration capable of certainly preventing generation of offset particularly when a small particle size toner without particle size adjustment is used.

And, it is an object of the present invention to provide an image formation apparatus capable of certainly preventing generation of offset, particularly the present invention has been achieved in order to solve the problem of cleaning of a fixing roller, it is an another object of the present invention to provide a web differential gear and an image formation apparatus comprising a configuration capable of reducing loosening of the web without leading to damage on the web itself.

According to one aspect of the present invention, there is provided a fixing device which fixes the toner image on the sheet after transferring a toner image formed by visualizing an electrostatic latent image on a latent image supporting member onto a sheet, comprising, a web to be wound around on a pair of rollers, taken out from the taking out roller on one side to the taking up roller on the other side, with a part of the taken out part contacted with a member which heats and fuses the toner, and a controlling unit which controls the taking out amount of the taken out part according to the surface state of the sheet for supporting the toner image.

According to another aspect of the present invention, there is provided a web differential gear comprising, a taking out side rotation shaft with a web wound around for taking out the wound around web, a pressuring unit which pressures the taking out web against the surface of a subject to be cleaned, a taking up side rotation shaft for taking up the web pressured against the surface, and a load applying unit which directly applies a rotation load of 150 gf·cm or more on the taking out side rotation shaft of the web.

According to still another aspect of the present invention, an image formation apparatus comprises the fixing device.

According to still another aspect of the present invention, an image formation apparatus comprises the web differential gear.

Other objects and features of this invention will become understood from the following description with reference to the accompanying drawings.

BRIEF DESCRIPTION OF THE DRAWINGS

FIG. 3A is a block diagram, and FIG. 3B is a diagram of an operation panel used for the controller;

FIG. 6A is a front view, and FIG. 6B is an enlarged diagram of the part shown by the mark B in the FIG. 6A;

DETAILED DESCRIPTIONS

Hereinafter, with reference to embodiments shown in the figures, a first embodiment and a second embodiment of the present invention will be explained.

First Embodiment

Figure 1:
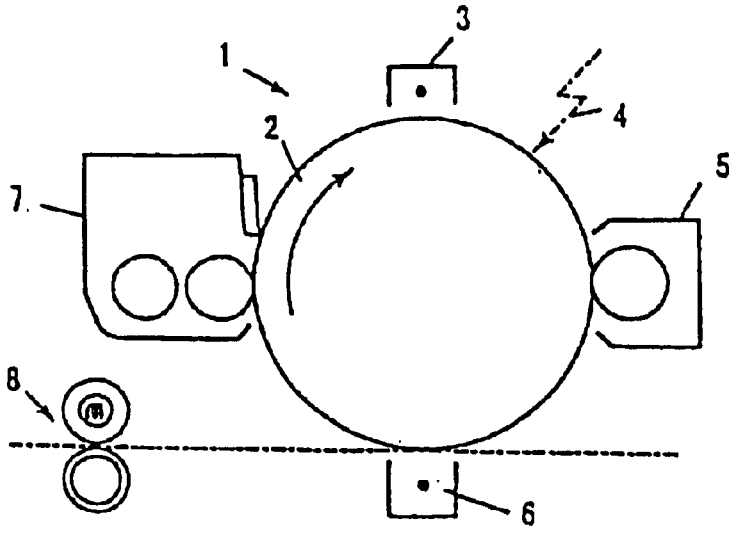
FIG. 1 is a schematic diagram which shows an example of an image formation apparatus commonly used for embodiments of the present invention.

FIG. 1 is a schematic diagram of an image formation apparatus comprising a fixing device of a first embodiment of the present invention. The image formation apparatus shown in the figure is a copying machine capable of forming an electrostatic latent image by an exposing light. In the present invention, not only the copying machine but also a printer, a facsimile device or printing machine can be used as the image formation apparatus.

In FIG. 1, the copying machine 1 comprises a photosensitive drum 2 as the latent image supporter, with a charging device 3 which executes the image formation process in the rotation step, an exposing device 4, a developing device 5, a transfer device 6 and a cleaning device 7 disposed in the vicinity of the photosensitive drum 2.

In the copying machine 1, after uniform charging by the charging device 3, an electrostatic latent image is formed on the photosensitive drum 2 via the exposing device 4, and a visualizing process is applied to the electrostatic latent image using a toner supplied by the developing device 5. The toner image on the photosensitive drum 2 after the visualizing process is transferred onto a sheet taken out from an unshown paper feeding device via the transfer device 6. The photosensitive drum 2 after the transfer has the untransferred toner and the residual charge eliminated by the cleaning device 7, and the uniform charging by the charging device 3 applied so as to be prepared by the next image formation.

In the first embodiment, as the developing agent used in the developing device 5, a toner having a 5 to 10 $\mu$m average particle size value of particles in unit volume, containing 60 to 80% of those having a 5 $\mu$m or less particle size (60 to 80% out of the total particle number have a 5 $\mu$m particle size) is used. As to the toner configuration, one made of a resin component and a coloring agent, and furthermore, a wax component or an inorganic fine particle added can be used. The production method is not particularly limited, and thus either the pulverization method or the polymerization method can be used.

As to the resin component, any of the conventionally known resins can be used. Examples thereof include the followings.

Styrene resins (single polymer or copolymer including a styrene or a styrene substituent) such as styrene, a poly-$\alpha$-stilstyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-ester acrylate copolymer, a styrene-ester methacrylate copolymer, a styrene-$\alpha$-chlormethyl acrylate copolymer and a styreneacrylonitrile-ester acrylate copolymer, a polyester resin, an epoxy resin, a vinyl chloride resin, a rosin modified maleic acid resin, a phenol resin, a polyethylene resin, a polyester resin, a polypropylene resin, a petroleum resin, a polyurethane resin, a ketone resin, an ethylene ethyl acrylate copolymer, a xylene resin, a polyvinyl butylate resin, or the like can be presented. Moreover, the resins can be used alone or in a combination of two or more.

As the coloring agent, conventionally known agents such as a carbon black, a lamp black, an iron black, a ultramarine, a nigrosine dye, an aniline blue, a charcoyl blue, an oil black, an azo oil black, or the like can be presented, and it is not particularly limited. As the wax component, conventionally known waxes such as a carnauba wax, a ricewax, a synthesized wax, or the like can be presented, and it is not particularly limited. As the inorganic fine particle, known particles such as a silica, a titanium oxide fine powder, or the like can be used.

The sheet with the toner image transferred has the toner image fixed by the fixing device 8 disposed in the conveyance path elongating from the transfer position toward an unshown paper discharger.

The fixing device 8 comprising a fixing roller 8A storing the heat source and a pressuring roller 8B disposed facing in contact with each other with the conveyance path provided therebetween, is of the thermal roller fixing method of heating and fusing the toner by applying the heat and the pressure to the toner image.

Figure 2:
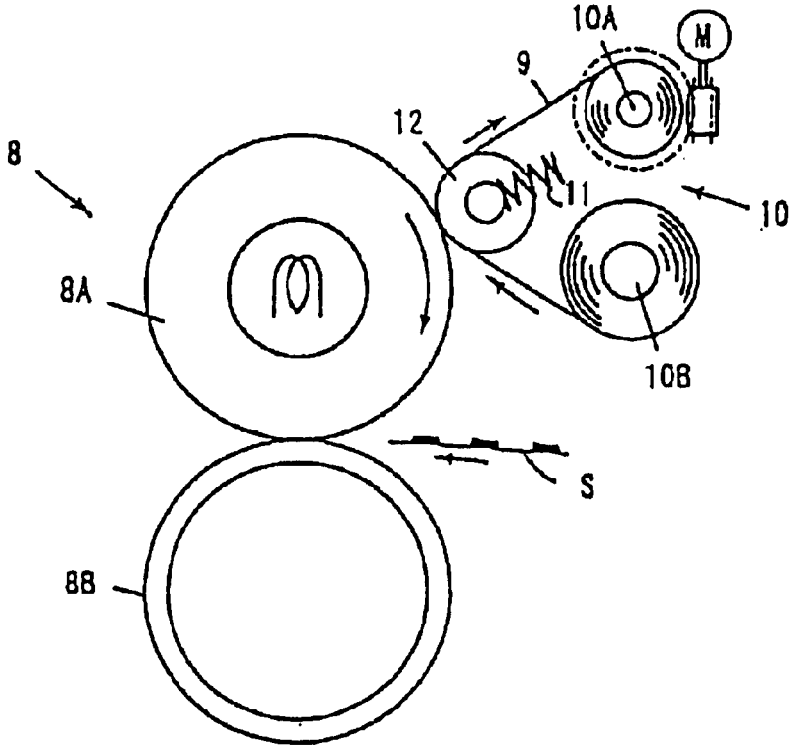
FIG. 2 is a schematic diagram which shows the main part configuration of a fixing device used for the image formation apparatus shown in FIG. 1.

FIG. 2 is a diagram which shows the details of the fixing device 8. In the figure, the fixing roller 8A is a member comprising a calorie conductor storing the heat source H, with a mold releasing layer made of a material such as a fluorine resin provided on the surface. The pressuring roller 8B comprises a mandrel with an elastic layer using an elastic material such as a silicone rubber provided on the outer circumferential surface such that a part of the circumferential surface is deformed along the circumferential surface of the fixing roller at the time it is contacted with pressure against the fixing roller 8A so as to provide a fixing nipper.

A web 9 and a web taking out device 10 are provided on the side of the fixing roller 8A as a member which heats and fuses the toner in the fixing device 8. The web taking out device 10 comprises a pair of rollers 10A, 10B with one of the rollers 10A serving as the taking up roller for the web 9, and the other roller 10B serving as the taking out roller for the web 9. The taking up roller 10A takes up the web 9 by transmission of the rotation driving force from the motor M to the driving force transmitting member such as a gear mounted on the rotation shaft of itself.

However, the present invention is not limited to the configuration of driving only the taking up roller 10A. For example, both the taking up roller 10A and the taking out roller 10B can be interlocked and driven.

The web 9 is fixed on the end parts in the longitudinal direction of the taking up roller 10A and the taking out roller 10B, with the part extended between the rollers pressured and contacted onto the fixing roller 8A surface by the pressuring roller 12 pressured and forced by an elastic member 11 such as a spring.

The web 9 is prepared by impregnating in an oil as needed a non-woven fabric produced by mixing an aramide and a polyethylene terephthalate (PET) fiber as a material capable of wiping off the toner offset on the fixing roller 8A surface by sliding on the circumferential surface of the fixing roller 8A at the time of taking up by the rollers. In addition to wiping off and collecting the offset toner, it can apply a mold releasing agent such as a silicone oil.

Figure 3A:
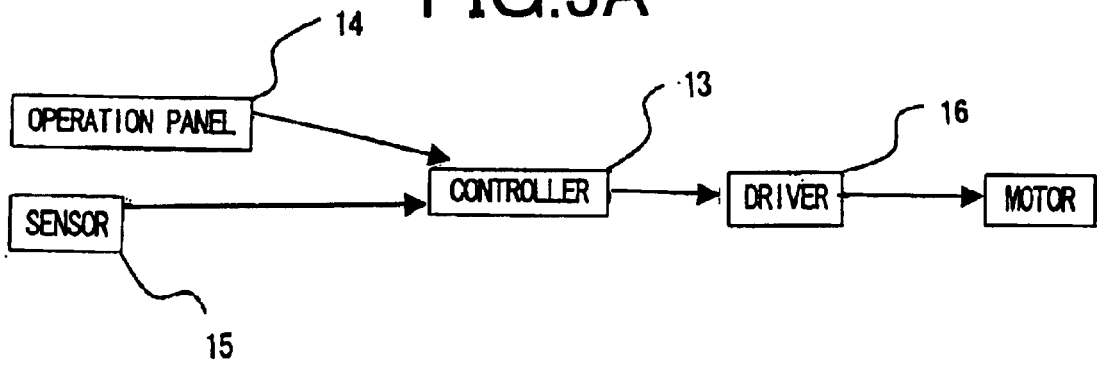
FIGS. 3A and 3B are diagrams which explain the configuration of a controller used for the main part configuration of the fixing device shown in FIG. 2.

The motor M as the driving source which takes up the web 9 has the driving amount controlled by a controller 13 shown in FIG. 3A. Thereby, the taking up amount of the web 9 can be set.

In FIG. 3A, the controller 13 comprises the main part with a microcomputer, with an operation panel 14 and a sensor 15 connected on the input side via an unshown I/O interface and a driver 16 of the motor M connected on the output side, respectively.

Figure 3B:
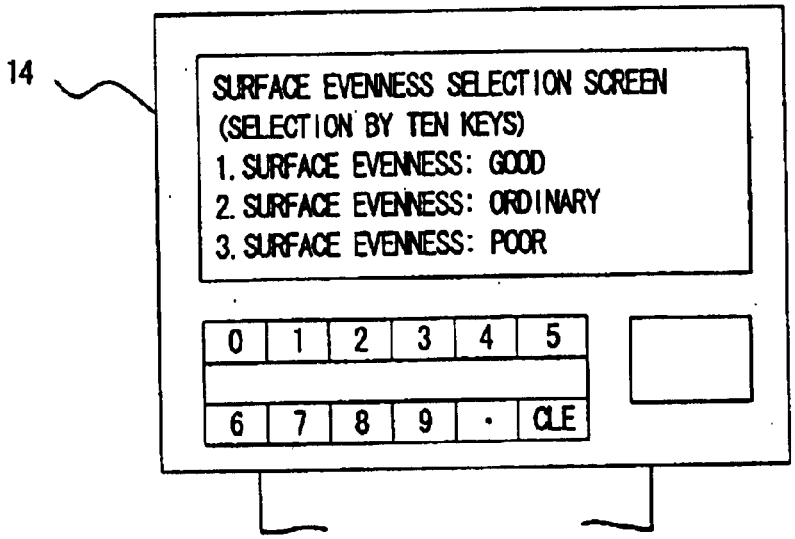

As shown in FIG. 3B, the operation panel 14 is a member provided in the operator of the copying machine 1, capable of inputting the level of the surface property of the sheet to be used. Although the level of the surface evenness is commanded directly in this embodiment, display of the "OHP", the "coated paper", the "plain paper", the "recycled paper", the "reused paper", or the like showing the difference of the smoothness and easily understandable for an operator can be provided as well. Moreover, in addition to the smoothness, the thickness stability evaluation can be provided as well. More specifically, the smoothness denotes the grade difference or the ruggedness generation frequency of the ruggedness partially observed on the paper surface derived from the factor of the material comprising the paper, such as the surface coarseness, and the thickness stability denotes the state with the thickness evenness at an optional position on the same paper surface. Both of them are included in a range of the surface evenness.

In addition to the operation panel 14, the sheet size can be designated. The size in this case is a parameter for determining the image formation length. The image formation length in this specification denotes the entire image length formed in a predetermined time, which is represented by the sheet size (length of a side)×the number of sheets with an image formed in a predetermined time.

A sensor 15 is a member used for detecting the surface evenness of a sheet. For example, when the sheet surface evenness is not designated by the operation panel 14, concerning the surface evenness, the ruggedness state and the thickness irregularity are detected using a tool for utilizing the direct contact such as a touch needle. Since the thickness irregularity can be detected as the ruggedness with the paper optional surface provided as the reference, the measurement operation can be same as in the case of the ruggedness. Moreover, in addition thereto, the detection can be carried out by a tool utilizing the air or the light as well.

In the controller 13, the motor M driving amount is set so as to have a large web 9 taking out amount when the surface evenness is low (ruggedness is large), and the motor M driving amount is set so as to have a web 9 taking out amount smaller than the above-mentioned in the case opposite to the former case.

It can be administered also by the motor M rotation amount. In this case, since the web diameter is changed as time passes by, administration of the rotational frequency may be needed with reference to the web diameter data according to the time passage. When the offset generation frequency is increased thereby, the toner wiping off amount form the fixing roller 8A can be increased by increasing the web 9 taking out amount.

The motor M driving amount is set so as to have a large web 9 taking out amount when the sheet is large, the image formation length is long, the image amount is large, that is, the toner use amount is large. In this case, the motor M driving amount is set as the "fluctuation of the driving amount derived from the difference in the surface evenness"+the "fluctuation of the driving amount derived from the difference in the sheet size".

Accordingly, the final web taking out amount is determined by the relationship between the surface evenness factor and the other factors (the total sum thereof as the simplest relationship). As an element other than the sheet size, the relative thickness of the sheet can be considered as well.

In the controller 13, the web 9 taking out amount with respect to the image formation length (sheet size) is registered preliminarily so that the web taking out amount can be selected with respect to the image formation length according to the elements such as the sheet smoothness, the thickness, the kind of the sheet, or the like.

For example, in the case of passing 100 pieces of an A4 size sheet per minute, for example, if the web 9 taking out amount with respect to the image formation length is set to be 0.5% with regard to the surface evenness and thickness element, since the image formation length is 210 mm (A4 size length)×100 (sheets)=21,000 mm, the web 9 taking amount per minute is 21,000 (mm)×0.005=10.5 (mm).

As to the web 9 taking out operation, it can be taken out by the value continuously for 1 minute, and it can also be taken out intermittently by repeating an operation stoppage of a certain length, such as 0.5 mm each for 21 times. Thereby, the taking out state can be selected corresponding to the offset generation state.

The controller 13 can also control the web taking out amount according to the image formation apparatus use environment conditions such as the temperature of melting the toner by the fixing roller 8A, the toner component and the image formation speed.

In this case, for example, the operation panel 14 may be provided with an input section for inputting the use environment conditions by an operator. Moreover, the image formation apparatus may be provided with a thermometer for measuring the toner melting temperature by the fixing roller 8A for automatically detecting the temperature and the humidity. Furthermore, when the toner component or the image formation speed is used as the use environment condition, the web 9 taking out amount can be set according to the toner component or the image formation speed by changing the web 9 taking out amount setting value according to the specification of the apparatus at the time of shipping the image formation apparatus.

Figures 4, 5:
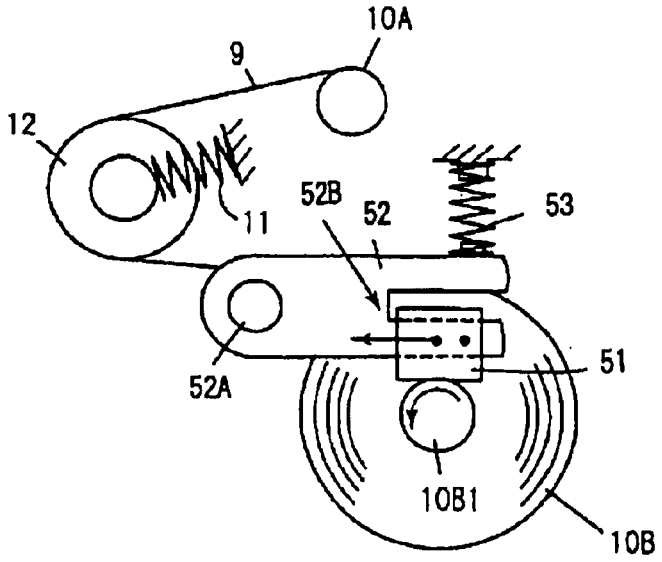
FIG. 4 is a table which shows the taking out ratio of the web with respect to the image formation length used in the controller shown in FIG. 3A.
FIG. 5 is a schematic diagram which explains the configuration of a web differential gear according to a second embodiment.
Figure 6A:
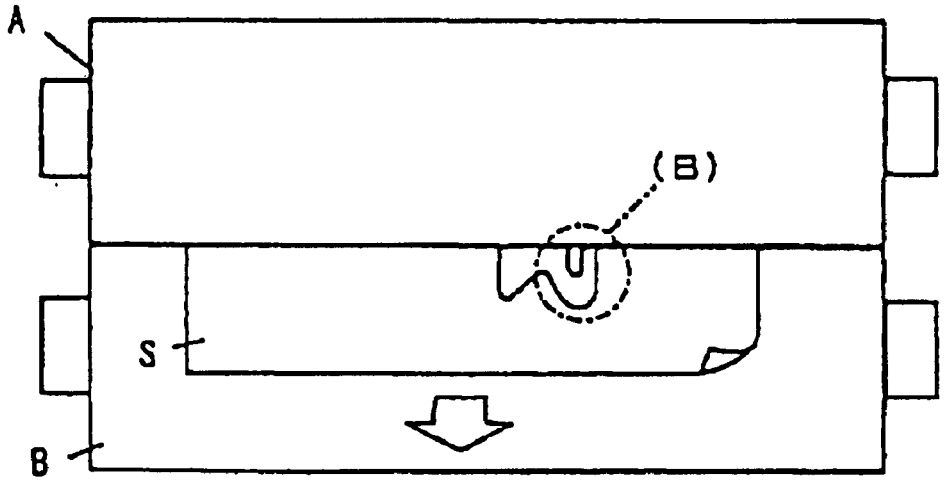
FIGS. 6A and 6B are diagrams which explain the phenomenon in the fixing device when a small particle size toner is used.
Figure 6B:
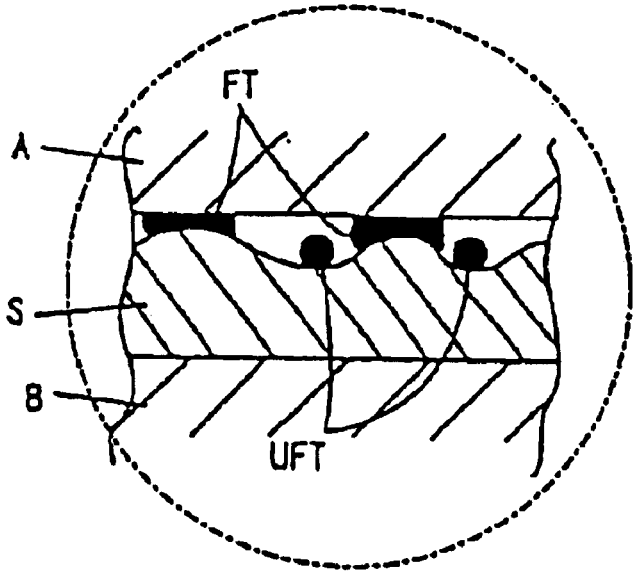
Figure 7A:
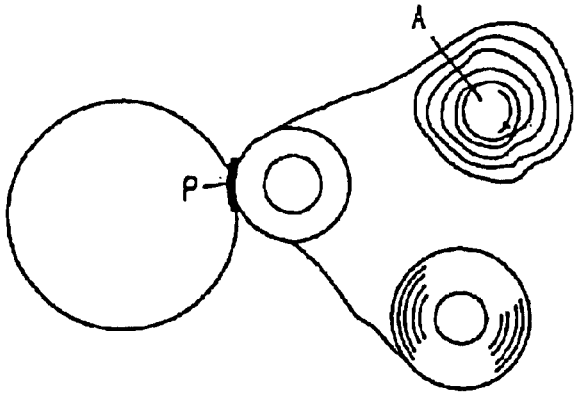
FIGS. 7A, 7B and 7C are diagrams which explain the loosening phenomenon of the web generated in the case of winding the web.
Figure 7B:
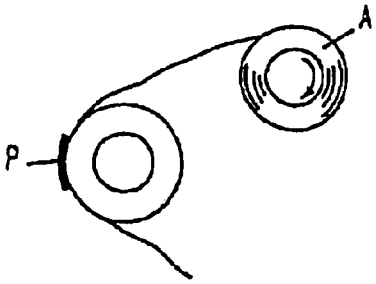
Figure 7C:
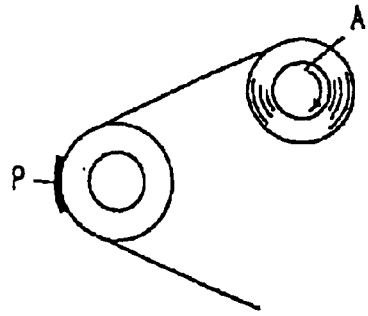
Figure 8:
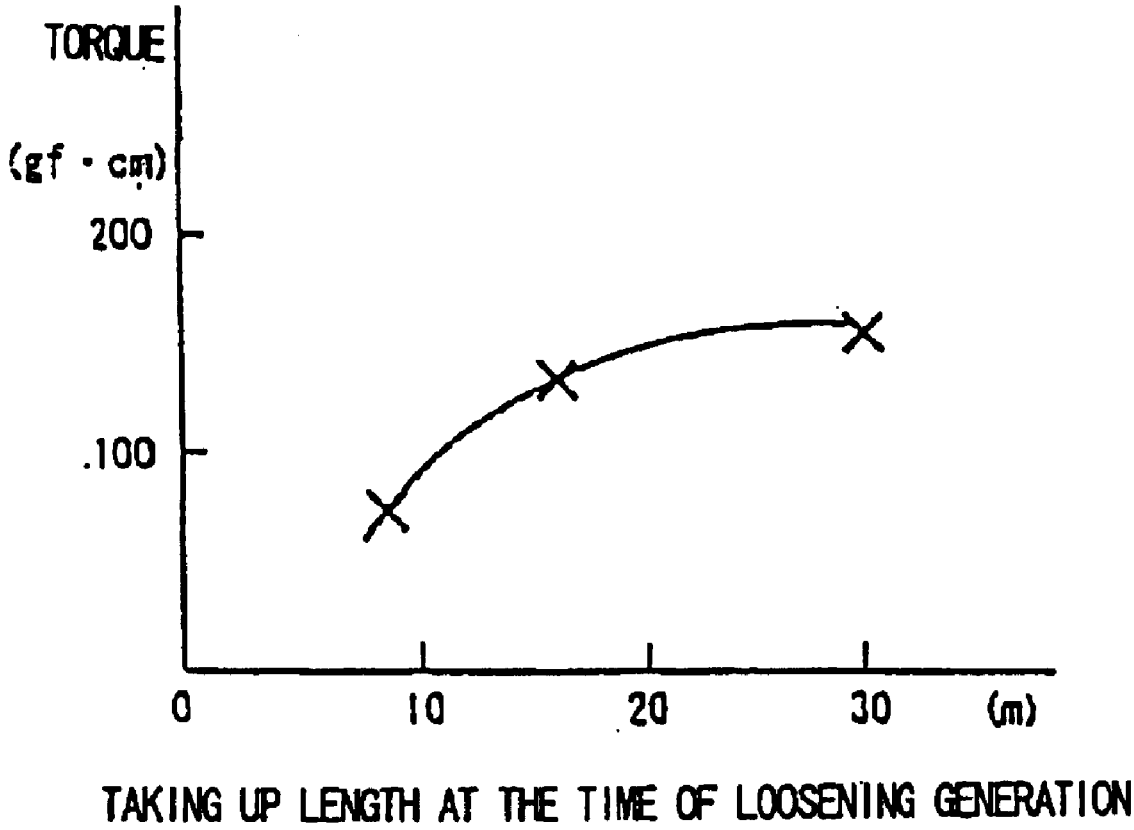
FIG. 8 is a graph which explains the relationship between the load and the loosening generation state when a rotation load is applied for preventing the web winding loosening phenomenon.

In the controller 13, concerning the web 9 taking out operation, the taking out amount limit value is set with respect to a sheet with the largest ruggedness and the poorest surface evenness. FIG. 4 shows the result of an experiment concerning the relationship between the web taking out ratio with respect to the image formation length and the surface evenness of the sheet (it is shown as the transfer paper in FIG. 4). As it is apparent from FIG. 4, it is learned that the web 9 taking out ratio (operation length ratio) is 0.008% with respect to the best surface evenness.

Since this embodiment has the configuration, when the copying machine 1 is driven, for the image formation, according to the content of the command from the operation panel 14, that is, the size and kind of the sheet and the thickness are designated, the image formation length is judged based on the sheet size so as to set the web 9 taking out amount in the controller 13.

Based on the taking out amount set in the controller 13, the motor M is driven so that the web 9 slides on the surface of the fixing roller 8A for wiping off the offset toner. Since the web taking out is made larger when the image formation length is large, the offset amount tends to be increased due to the large toner use amount. However, elimination of the offset can be promoted by increasing the toner wiping off amount by increasing the web 9 taking out amount following the tendency.

According to this embodiment, the state with little toner wiping off omission can be maintained only by adjusting the web 9 taking out amount.

In the embodiment, concerning the web operation, the "small particle size toner (without fine powdery toner elimination)" is used and the web feeding amount is set in view of the surface evenness and the other elements. The table 2 shows setting of the web viewed only from the surface evenness with respect to each toner.

TABLE 2

| | Poor smoothness (coarse) | Ordinary smoothness | Good smoothness |
|---|---|---|---|
| Ordinary particle size | 4 mm/minute | 2 mm/minute | 1 mm/minute |
| Small particle size (with fine powder elimination process application) | 8 | 4 | 2 |
| Small particle size (without fine powder elimination process application) | 12 | 6 | 3 |

According to the setting, the web winding amount can be optimized according to the surface evenness. What is remarkable here is that setting of 1.5 times is needed for the case of a small particle size (without the fine powdery toner elimination) compared with the case with the fine powdery toner elimination).

Second Embodiment

A web differential gear according to a second embodiment of the present invention will be explained. The web differential gear according to the second embodiment of the present invention is provided in the copying machine same as that for the fixing device of the first embodiment. Therefore, in the configuration of the second embodiment, the same members as in the first embodiment are provided with the same numerals and explanation will partially be omitted.

FIG. 5 is a schematic diagram which shows the configuration on the taking out roller 10B side. In the figure, an elastic member 51 is contacted directly with at least one end in the axial direction of the rotation shaft 10B1 of the taking out side roller 10B for applying the rotation load to the rotation shaft 10B1. A rubber is used here for the member which applies the rotation load because the rubber is considered to be optimum for applying a load of 150 gf·cm or more in a high temperature condition in a limited space. Moreover, in order to increase the friction force between the taking out side rotation shaft and the rotation load member, the surface can be processed to be coarse for mutual engagement or the rotation load may be applied according to the material, the configuration (configuration of a torque limiter type, or the like) of the taking out shaft bearing member, or the like.

In FIG. 5, the elastic member 51 made of a silicone rubber having a heat resistance at 40 Hs or more Askar hardness, is disposed on the free end of a swayable bracket 52 having a pivot 52A on the base end. The bracket 52 is provided with a sideway U-shaped section 52B on the free end, with the elastic member 51 mounted on one side piece.

The bracket 52 contacted with the end part of a forcing member 53 such as a spring on the opposite side with respect to the mounting position of the elastic member 51 on the free end such that the elastic member 51 is pressured on the rotation shaft 10B1 by the forcing member 53. The elastic member 51 is contacted with the rotation shaft 10B1 by a 150 gf·cm or more pressure by the force of the forcing member 53 so as to apply the rotation load to the rotation shaft 10.

Since the elastic member 51 is directly contacted with the rotation shaft 10B1, it receives the rotation force of the rotation shaft 10B1 so as to be moved to the direction of the tangent of the rotation shaft 10B1 (direction shown by the arrow in FIG. 5). In this embodiment, in order to limit the movement in the tangent direction, the U-shaped base section 52B formed on the free end of the bracket 52 is used.

The base section 52B stops the elastic member 51 for limiting the movement of the elastic member 51 to the rotation tangent direction of the rotation shaft 10B1. In this embodiment, in order to stop the elastic member 51, the rotation direction of the rotation shaft 10B1 is set so as to obtain the movement direction parallel with the elastic member 51 mounting direction (arrow direction in the figure) at the contact position with the elastic member 51.

Since the present embodiment has the configuration, when the taking up roller 10A is driven and rotated in the web differential gear 10, the web 9 is taken out from the taking out roller 10B side.

Since the taking out roller 10B is provided with the rotation load by the elastic member 51 directly contacted with the rotation shaft 10B1 for pressuring, the state without generation of loosening of the web 9 can be maintained. In particular, the web 51 has the temperature rise according to the heat conduction from the fixing roller 8A so that the rotation shaft 10B1 of the taking out roller 8B with the same wound around has the temperature rise as well, however, since the elastic member 51 contacted with the rotation shaft 10B1 is a heat resistant member, it can apply a predetermined rotation load continuously and stably without giving rise to the temperature change.

The present inventor had an experiment concerning the relationship of the Askar hardness of the elastic member 51 with respect to the temperature rise of the rotation shaft 10B1 so as to obtain the following result. That is, when the rotation shaft 10B1 becomes about 130° C. and the silicone rubber hardness is less than 40 Hs, it become softened so that it is difficult to set a pressure of 150 gf·cm or more as the rotation load value. Moreover, when the silicone rubber hardness is set at 30 Hs, it is broken as time passes by. From the result, in consideration of the hardness irregularity of about ±5 HS, the allowance is discussed so as to set 40 Hs or more.

Since the web 9 provided in the configuration in the second embodiment of the present invention is used for cleaning the fixing roller 8A controlled at a temperature in the vicinity of 180° C., the offset phenomenon is not observed in the case of executing in a condition of operating the web 9 by 2 mm at about 5 second image formation, with a 24 m or more web extension distance and a 100 g/m$^2$ bulk density amount.

The condition of "operating the web 9 by 2 mm at about 5 second image formation with the assumption of 24 m or more web total amount" denotes use of an extremely large amount of the web. This is derived from the toner condition in this embodiment. As another condition of using such an extremely large amount of the web, "for example, a condition of moving by 1 mm per copying 2 to 3 sheets, a condition of moving by 4 mm or more per copying 10 sheets, a condition of moving by 2 mm after finishing or immediately before starting a one mode copying operation" or the like can be considered.

According to the present embodiment, since the surface of the member can be wiped off with the web capable of taken out with respect to the member which heats and fuses the toner, the toner to cause the offset can be eliminated certainly without repeated contact of the same surface, and thus generation of the image failure derived from the offset toner can be prevented.

Since the web taking out length can be controlled according to the sheet surface evenness and the image length, the transferred toner can be wiped off substantially completely according to the toner amount transferred on the member which heats and fuses the toner while contacting.

Since the web taking out state and the taking out amount can correspond with the offset generation state and use amount, generation of the offset can be prevented certainly. In particular, since the web taking out amount is set at 0.008% or more with respect to the image formation length in the present invention, generation of the residual offset toner after wiping can be prevented even when the rugged state existing on the surface of the sheet to be used is largest. Thereby, generation of the offset can be restrained.

Since the rotation load is applied directly on the rotation shaft on the web taking out side, unlike the case of applying the load onto the web surface, generation of loosening can be restrained while preventing damage on the web surface.

Since the elastic member capable of pressuring the rotation shaft on the web taking out side by direct contact is provided, the configuration of applying the rotation load need not be provided on the outer circumference of the web, and thus loosening of the web can be prevented without generating bulkiness of the structure.

Since the elastic member can comprise the optimum member which applies a 150 gf·cm or more load in a limited space and a high temperature condition, the rotation load can be applied on the rotation shaft continuously and stably.

Since the hardness capable of maintaining the contact state with the rotation shaft is provided, the rotation load can be applied onto the rotation shaft continuously and stably.

Since the movement of the elastic member directly contacted with the rotation shaft at the time the elastic member receives the rotation force of the rotation shaft can be limited, the rotation load can always be applied to the rotation shaft, and thus the state with the web loosening released can be maintained.

Since the wiping condition by the web without contact with the member which heats and fuses the toner again in the same part can be optimized corresponding to the offset generation, particularly when a toner of a size easily entering into the sheet ruggedness as the developing agent is used, the toner can be wiped off appropriately so that image formation failure by the offset generation can be prevented certainly.

Since the web itself can be loosened without damaging the web surface, deterioration of the efficiency of wiping the member to be contacted with the web can be prevented.

When a developing agent containing a small particle size toner is used as the developing agent, since the wiping operation using the web can be enabled at the part the toner can easily jump to as well as loosening of the web itself can be prevented stably without deterioration of the wiping efficiency, generation of a polluted part in the image formation apparatus can be prevented so that image formation failure can be prevented as well.

Since loosening of he web can be prevented at the time of eliminating the offset toner on the fixing roller or the foreign substance, image formation failure generation can be prevented by improving the wiping efficiency for the toner or the foreign substance.

The present document incorporates by reference the entire contents of Japanese priority documents, 2001-168334 filed in Japan on Jun. 4, 2001, 2001-168341 filed in Japan on Jun. 4, 2001, 2002-131243 filed in Japan on May 7, 2002 and 2002-131244 filed in Japan on May 7, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A fixing device which fixes a toner image on a sheet after transferring the toner image formed by visualizing an electrostatic latent image on a latent image supporting member onto the sheet, comprising:

a web to be wound around on a pair of rollers, taken out from a taking out roller on one side to a taking up roller on the other side, with a part of the taken out part contacted with a member which heats and fuses a toner; and a controlling unit which controls the feed of the taken out part according to a surface roughness of the sheet for supporting the toner image.

2. A fixing device which fixes a toner image on a sheet after transferring the toner image formed by visualizing an electrostatic latent image on a latent image supporting member onto the sheet, comprising:

a web to be wound around on a pair of rollers, taken out from a taking out roller on one side to a taking up roller on the other side, with a part of the taken out part contacted with a member which heats and fuses a toner;

a controlling unit which controls the taking out amount of the taken out part according to a surface state of the sheet for supporting the toner image;

a driving source which drives at least one of the pair of the rollers;

an inputting unit which inputs the surface evenness of the sheet; and a controlling unit which controls the driving amount of the driving source according to the web taking out amount to be set based on the input surface evenness and the image formation length.

3. The fixing device according to claim 2, wherein the controlling unit controls the driving source which takes out the web continuously or intermittently.

4. The fixing device according to claim 2, wherein the controlling unit controls the taking out amount of the web according to the use environment condition.

5. The fixing device according to claim 2, wherein the controlling unit sets the web taking out amount by at least 0.008% or more of the image formation length.

6. The fixing device according to claim 2, wherein the taking out amount is set further according to the toner use amount.

7. A web differential gear comprising:

a taking out side rotation shaft with a web wound around for taking out the wound around web;

a pressuring unit which pressures the taking out web against the surface of a subject to be cleaned;

a taking up side rotation shaft for taking up the web pressured against the surface; and a load applying unit which directly applies a rotation load of 150 gf·cm or more on the taking out side rotation shaft of the web.

8. The web differential gear according to claim 7, wherein the load applying unit comprises an elastic member to be contacted directly with the taking out side rotation shaft for pressuring the taking out side rotation shaft so as to provide the rotation load.

9. The web differential gear according to claim 8, wherein the elastic member includes a rubber member.

10. The web differential gear according to claim 8, wherein the elastic member is made of a silicone rubber of a 40 Hs or more Askar hardness.

11. The web differential gear according to claim 8, further comprising a stopping unit which limits the movement of the elastic member in a rotation tangent direction of the taking out rotation shaft.

12. An image formation apparatus comprising a fixing device which fixes a toner image on a sheet after transferring the toner image formed by visualizing an electrostatic latent image on a latent image supporting member onto the sheet, comprising:

a web to be wound around on a pair of rollers, taken out from a taking out roller on one side to a taking up roller on the other side, with a part of the taken out part contacted with a member which heats and fuses a toner; and a controlling unit which controls the feed of the taken out part according to a surface state roughness of the sheet for supporting the toner image.

13. The image formation apparatus according to claim 12, wherein a developing agent contains a toner having a 5 to 10 $\mu$m volume average particle size, containing 60 to 80% of the particles having a 5 $\mu$m or less particle size.

14. An image formation apparatus comprising a web differential gear comprising:

a taking out side rotation shaft with a web wound around for taking out the wound around web;

a pressuring unit which pressures the taking out web against the surface of a subject to be cleaned, a taking upside rotation shaft for taking up the web pressured against the surface; and a load applying unit which directly applies a rotation load of 150 gf·cm or more on the taking out side rotation shaft of the web.

15. The image formation apparatus according to claim 14, comprising a developing device which supports a developing agent containing a toner having a 5 to 10 $\mu$m volume average particle size, containing 60 to 80% of the particles having a 5 $\mu$m or less particle size.

16. An image formation apparatus capable of cleaning a fixing roller using a web differential gear comprising:

a taking out side rotation shaft with a web wound around for taking out the wound around web;

a pressuring unit which pressures the taking out web against the surface of a subject to be cleaned;

a taking up side rotation shaft for taking up the web pressured against the surface; and a load applying unit which directly applies a rotation load of 150 gf·cm or more on the taking out side rotation shaft of the web.

17. The image formation apparatus according to claim 16, comprising a developing device which supports a developing agent containing a toner having a 5 to 10 $\mu$m volume average particle size, containing 60 to 80% of the particles having a 5 $\mu$m or less particle size.

* * * * *